United States Patent [19]

Ahlstone

[11] 3,944,273

[45] Mar. 16, 1976

[54] RETRIEVING TOOL FOR WELLHEAD PACKING

[75] Inventor: Arthur G. Ahlstone, Ventura, Calif.

[73] Assignee: Vetco Offshore Industries, Inc., Ventura, Calif.

[22] Filed: June 3, 1974

[21] Appl. No.: 475,586

[52] U.S. Cl. ..... 294/86.1; 294/86.15; 294/86.18; 294/86.24; 294/86.34

[51] Int. Cl.[2] ..... E21B 31/02

[58] Field of Search..... 294/86.1, 86.14, 86.15, 294/86.17, 86.18, 86.24, 86.25, 86.28–86.33, 86.34, 90, 93, 99 R; 166/98, 99, 216, 217

[56] References Cited

UNITED STATES PATENTS

| | | | |
|---|---|---|---|
| 1,757,363 | 5/1930 | Fischbach | 294/86.15 |
| 1,917,135 | 7/1933 | Littell | 294/86.25 X |
| 2,232,949 | 2/1941 | Jones et al. | 294/86.31 |
| 2,243,419 | 5/1941 | Festervan et al. | 294/86.18 |
| 2,804,927 | 9/1957 | Hall | 294/86.34 |
| 3,150,718 | 9/1964 | Crowe | 294/86.25 X |
| 3,208,788 | 9/1965 | Roark | 294/86.15 |
| 3,352,593 | 11/1967 | Webb | 294/86.34 X |
| 3,698,756 | 10/1972 | Groves | 294/86.25 X |

*Primary Examiner*—Evon C. Blunk
*Assistant Examiner*—Johnny D. Cherry
*Attorney, Agent, or Firm*—Bernard Kriegel

[57] ABSTRACT

A retrieving tool has resilient fingers engageable with a pulling collar of the actuator ring of a wedge locked underwater wellhead packing to release the lock and the packing for retrieval from the wellhead. The retrieving tool has a body connected to a running pipe string and provided with washing ports. In one form the resilient fingers are releasable from the pulling collar in response to fluid pressure supplied through the running string.

18 Claims, 8 Drawing Figures

RETRIEVING TOOL FOR WELLHEAD PACKING

The present invention relates to well apparatus, and more particularly to apparatus for retrieving a seal which has been set and locked in packed off condition in the region between a hanger body and a surrounding wellhead housing disposed at the upper end of the well bore.

In the drilling of oil and gas wells at an underwater location, a casing string is run into a well bore, the casing string being supported by a hanger body resting on a companion seat in a surrounding wellhead. The casing string is cemented in place and a suitable packing or seal assembly actuated to packoff the annular region between the hanger body and wellhead.

As disclosed in my copending application Ser. No. 474,019, filed May 28, 1974, now U.S. Pat. No. 3,913,670, the packing assembly is lowered from a drilling barge into position within the wellhead through use of a running string secured to a running and setting tool releasably connected to the packing assembly. The running string is weighted by the use of heavy drill collars below or above the running and setting tool to initially deform the packing in the annular space between the casing hanger and wellhead housing, and fluid under pressure can be applied to test the efficacy of the seal. Such applied fluid pressure also provides a force tending to effect further deformation of the packing, if necessary or possible. Fluid pressure is also operable on the setting and running tool to effect the locking of a wedge-lock device which prevents the packing from recovering and breaking the seal. Thereafter, the running and setting tool is released from the packing and wedge-lock device for recovery or retrieval to the drilling rig.

More particularly, the wedge-lock device for holding the packing packed off comprises a normally expanded resiliently contractable locking ring engageable with a tapered shoulder externally of the casing hanger body and a wedge ring normally held in a position allowing the lock ring to be in its expanded position, but releasable to be moved axially to circumferentially deform the lock ring inwardly into locking co-engagement with a locking recess or tapered shoulder of the casing hanger. The wedge ring and the lock ring have cooperative locking wedge surfaces whereby the locking action is maintained to hold the packing in a packed off condition.

In the event it becomes necessary to release the packing, the locking wedge ring is provided with a pulling collar having a downwardly facing fishing shoulder whereby the wedge ring can be pulled from its locking position by an appropriate pulling or retrieving tool.

The present invention provides a retrieving tool adapted to be connected to a running pipe string and lowered into engagement with the pulling collar of the locking wedge ring of the packing apparatus to pull the wedge ring free from locking engagement with the lock ring of the packing apparatus to enable the apparatus to be retrieved.

In addition, the retrieving tool has ports communicating with the running string and jet nozzles to enable washing or flushing of the locking mechanism when desired or necessary.

The retrieving tool has a plurality of circumferentially spaced flexible fingers having lugs at their lower ends automatically engageable with the pulling collar of the wedge-lock ring when the tool is lowered into the wellhead, so that an upward pull on the running string will pull the wedge ring upwardly to release the lock. The packing is carried by a supporting sleeve with which the wedge ring is associated, and the supporting sleeve has a shoulder engageable by the wedge ring so that continued upward movement of the running string will pull the packing free for retrieval with the retrieving tool when the running string is pulled to the rig at the top of the water.

In one form the flexible fingers of the pulling tool are integral with a supporting ring connected to the running tool body by a retainer ring. In the event that the wedge locking ring cannot be pulled free from its locking position the retainer ring may be sheared to enable retrieval of the retrieving tool. In another form the retrieving tool has fluid pressure operated actuator means selectively operable to actuate the pulling tool fingers from engagement with the pulling collar of the wedge-lock ring so that the retrieving tool may be retrieved along with the flexible fingers in the event that the wedge-lock ring and packing cannot be pulled free.

This invention possesses many other advantages, and has other purposes which may be made more clearly apparent from a consideration of the forms in which it may be embodied. These forms are shown in the drawings accompanying and forming part of the present specification. They will now be described in detail, for the purpose of illustrating the general principals of the invention; but is is to be understood that such detailed descriptions are not to be taken in a limiting sense.

Referring to the drawings.

In the drilling and completion of wells, such as oil and gas wells, from vessels on a body of water, the blowout preventer equipment and casing hanger equipment are located and supported in a base mounted on the floor of a body of water. The well casing is supported by a wellhead housing, and a marine riser pipe extends downwardly from the vessel to the blowout preventer which is connected to the wellhead housing, all as is well known.

Figure 1:
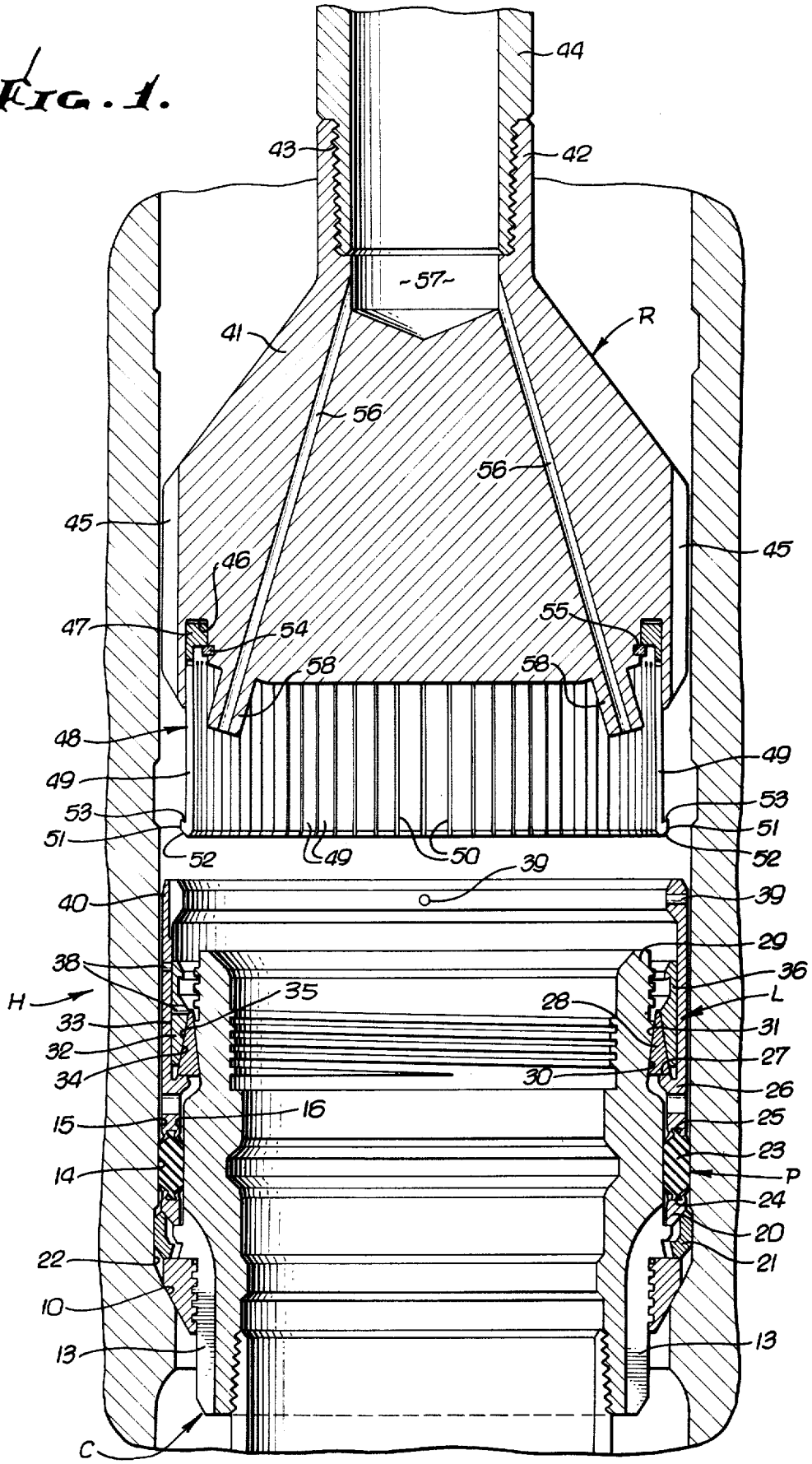
FIG. 1 is a view in vertical section, showing a wedge locked packing positioned between a casing hanger and a wellhead housing, with one form of a retrieving tool disposed in the wellhead housing prior to engagement with the locking wedge means.
Figure 2:
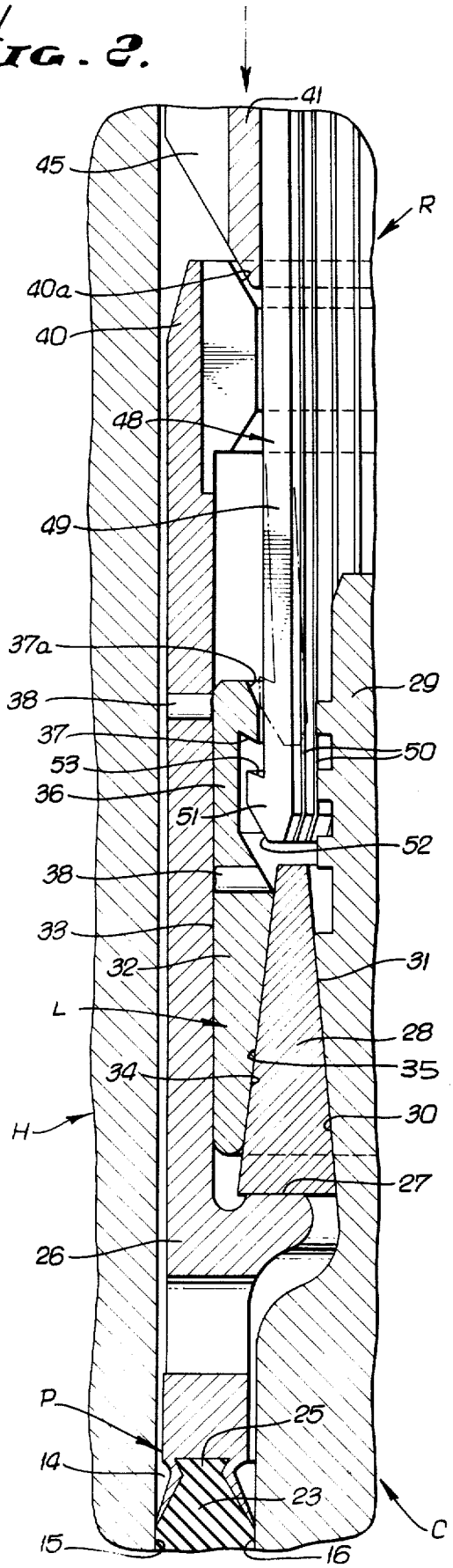
FIG. 2 is an enlarged fragmentary view in vertical section, showing, in full lines, the pulling tool lowered for engagement with the locking wedge ring, and showing, in broken lines, the fingers being cammed inwardly to pass the pulling collar.
Figure 3:
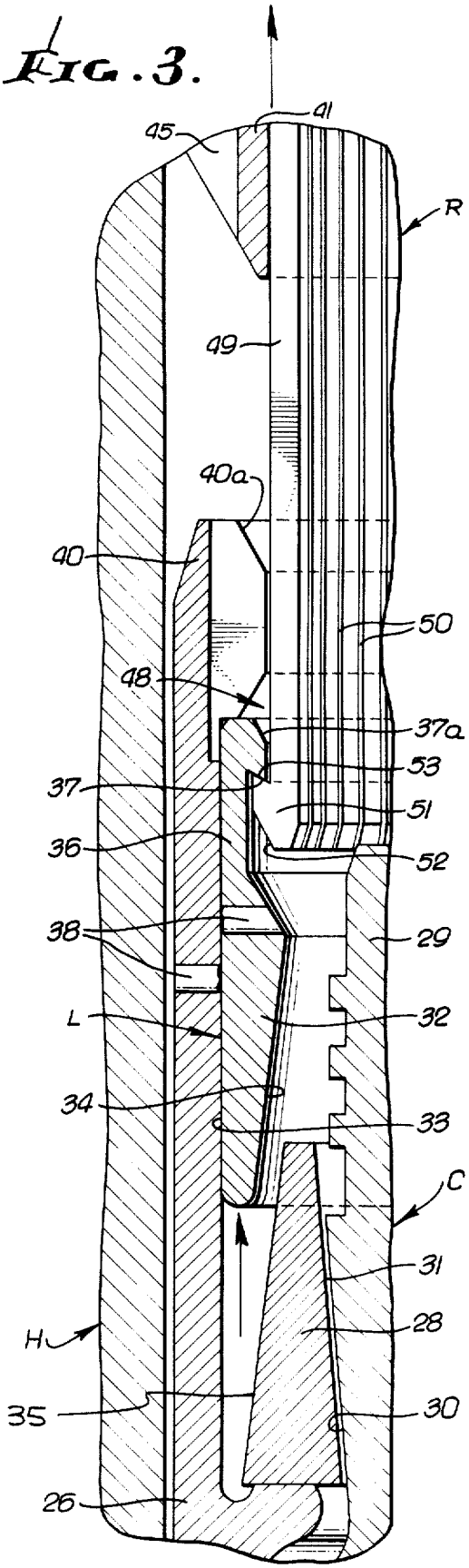
FIG. 3 is a view generally corresponding to FIG. 2, but showing the pulling tool elevated for engagement with the pulling neck of the locking wedge ring.
Figure 4:
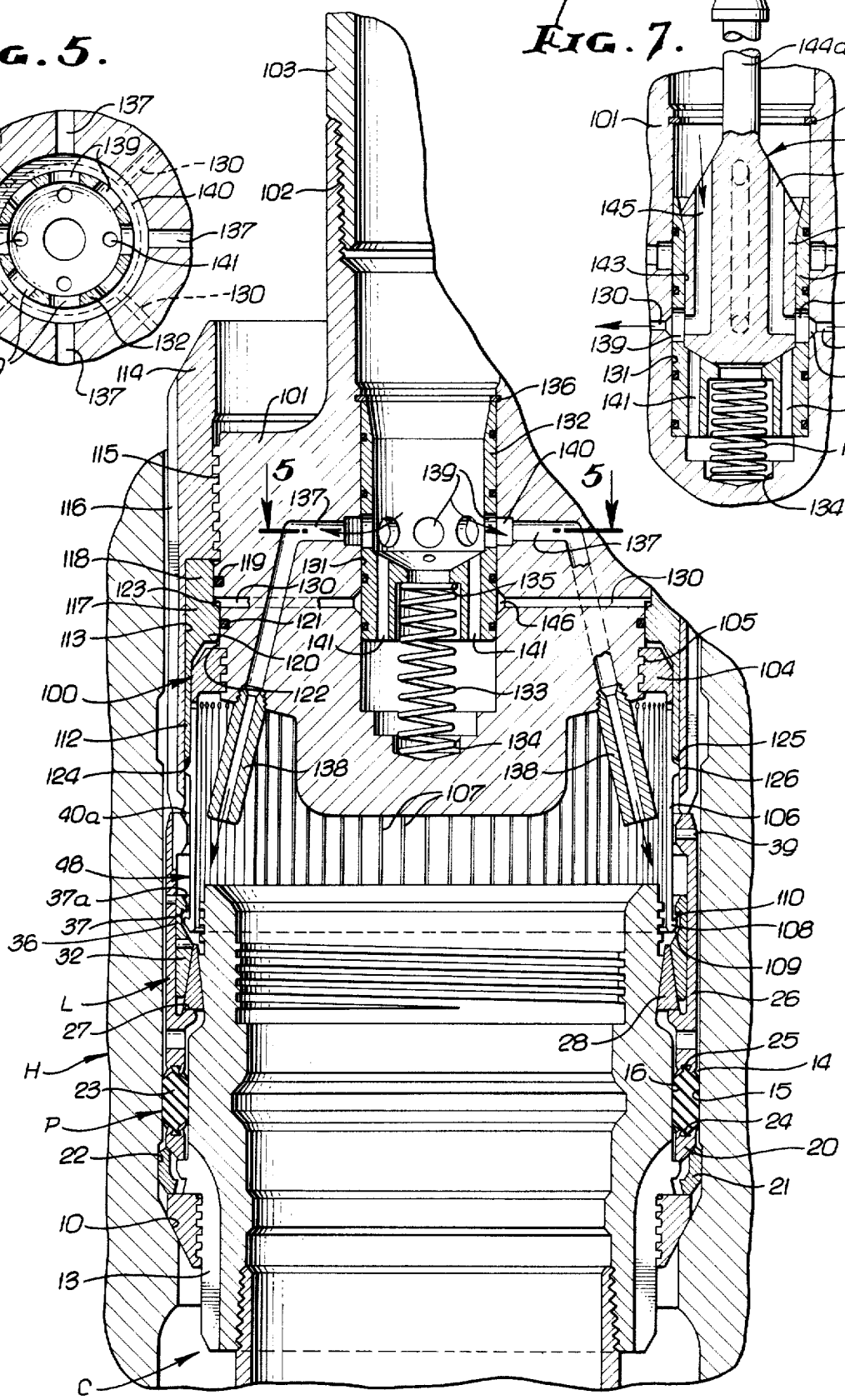
FIG. 4 is a view in vertical section, showing another form of pulling tool disposed in the wellhead housing and positioned for engagement with the pulling collar of the wedge-lock ring.
Figure 5:
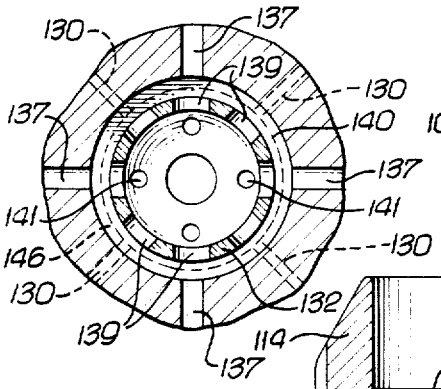
FIG. 5 is a fragmentary detail view in section, as taken on the line 5—5 of FIG. 4.

As seen in the drawings, referring first to the embodiment of FIGS. 1 through 3, the wellhead housing H has a casing hanger body C landed therein and supported upon an upwardly facing seat or shoulder 10. The casing hanger C has suitable passages 13 whereby circulating and cementing operations can be conducted in the usual manner by the displacement of cement downwardly through the casing, fluid in the well being displaced upwardly through the passages 13 and through an annular space 14 defined between the cylindrical inner wall 15 of the housing H and the opposing cylindrical wall 16 of the casing hanger C.

A seal is formed between the opposing cylindrical walls 15 and 16, after the cementing operation is completed, by setting a packing P in the annular space 14 in sealing engagement between the opposing cylindrical walls 15 and 16 and securely locking the packing in packed off condition by locking means L, the packing means P and the locking means L being lowered from the drilling vessel on a running and setting tool (not shown) which is connected to a running pipe string. Suitable running and setting tools for running and setting the packing P in the annulus 14 and actuating the locking means L to the illustrated packed off and locked condition are shown and described in my copending application for U.S. patent Ser. No. 474,019, filed May 28, 1974.

The packing P is shown in a packed off condition and includes a lower abutment ring or collar 20 which is in abutting engagement with a split-lock ring 21 shown as expanded outwardly into a locking groove 22 in the housing H, whereby the casing hanger C is locked in the housing H, as is customary. In addition, the packing P includes an annular body 23 of resiliently deformable elastomeric sealing material connected by a dove-tailed connection 24 to the lower ring 20, and by a corresponding upper dove-tailed connection 25 with a packing support sleeve 26. The packing body 23 is deformable outwardly and inwardly into sealing engagement with the opposed cylindrical walls 15 and 16, respectively, of the housing H and the casing hanger C upon axial deformation of the packing body. Such a packing is more fully disclosed in U.S. Pat. No. 3,797,864, granted Mar. 18, 1974, for "Combined Metal and Elastomer Seal."

The packing support sleeve 26, at a location above the packing 23, has an internal upwardly facing shoulder or seat 27 on which rests a split resilient lock ring 28 which is normally of such diameter as to pass downwardly over the upwardly extended annular section 29 of the casing hanger C. This casing hanger section 29 is undercut on its outer periphery at 30 to provide a groove, or, as shown in this specific embodiment, a downwardly and inwardly tapered annular surface adapted to receive the correspondingly downwardly and inwardly tapered side 31 of the lock ring 28, when the latter is deformed inwardly from its normally expanded condition to its contracted or locking position. In order to effect locking contraction of the lock ring 28 a lock ring actuator 32 is provided. This lock ring actuator is in the form of an annular wedge having an outer cylindrical wall 33 slidably disposed within the packing support sleeve 26 and an inner downwardly and outwardly tapered wedge surface 34 opposed to and engageable with the outer downwardly and outwardly tapered surface of the lock ring 28, whereby upon downward movement of the actuator 32 within the support sleeve 26, the lock ring 28 will be wedged or cammed circumferentially inwardly to the locking position with the locking surface 30 of the casing hanger C. The angles of the surfaces 34 and 35 of the actuator or wedge locking ring 32 and the lock ring 28, respectively, are selected to be locking wedge angles, so that once the wedge action has deformed and locked the lock ring 28 in place, the actuator 32 must be forcefully retracted before the lock ring can be released. Accordingly, the actuator 32 has an internally undercut neck 36 at its upper extremity and an internal fishing or retrieving shoulder or collar 37 adapted to be engaged by a pulling tool, such as the wedge-lock pulling tool hereinafter to be described.

During the lowering of the packing and the locking assembly through the riser pipe and into the wellhead housing H, and during the initial packing off of the packing P, the actuating wedge 32 is held in an upper inoperative position by releasable means such as one or more shear pins 38 which interconnect the actuator 32 to the packing support sleeve 26. These shear pins are selected so that they will retain the actuator 32 in the initial position until the packing is fully set, and a downward force is applied to the actuating wedge 32 to shear the pins 38 enabling downward locking movement of the actuator wedge 32. Shear pins 39 initially connect the upper end 40 of the packing support sleeve 26 to the running and setting tool and are sheared when the setting and running tool is retrieved.

The retrieving tool R, in accordance with one form of the invenntion, comprises a body 41 having an upper hollow neck 42 threadedly connected at 43 to the lower end of a pipe string 44 which constitutes an operating string extending to the rig and on which the retrieving tool R is adapted to be lowered through the riser pipe into the wellhead housing H and into engagement with the packing and locking apparatus previously described, to release and pull the same. The body 41 is of such a size as to center the body within the housing H and has longitudinally extended fluid by-pass passages 45 at circumferentially spaced locations about the body to enable it to freely pass downwardly through fluid in the housing. Formed in the body 41 is a downwardly opening annular groove 46 in which is received an upper solid ring section 47 of flexible collett or finger means 48. Such finger means 48 includes a plurality of circumferentially spaced downwardly extended fingers 49 integral with the supporting ring section 47, and separated by longitudinally extended slots 50. At the lower end of each finger 49 is an outwardly projecting lug 51 having a lower downwardly and inwardly inclined cam surface 52 and an upper downwardly and inwardly inclined shoulder 53. To support the ring section 47 within the groove 46 in the body 41 a retainer ring 54 is disposed in an annular groove 55 in the body 41 and engages beneath the ring section 47.

As seen in FIG. 2, as the retrieving tool R is lowered downwardly into the packing supporting sleeve 26, a bevelled cam surface **40*a* is extended internally so that the upper end 40 of the sleeve 26 will deflect the fingers 49 inwardly upon contact of the lower cam surfaces 52 of the lugs 51 so that the fingers can pass downwardly into the sleeve 26. Thereafter, as seen in broken lines in FIG. 2, the lower cam surfaces 52 of the fingers 49 engage an upper and inner bevelled surface 37*a* at the top of the wedge locking ring 32, to again deflect the fingers 49 inwardly so that the lugs 51 are enabled to pass downwardly through the pulling collar or shoulder 37 of the wedge locking ring 32. When the lugs 51 pass below the shoulder 37, the fingers 49 can normally flex outwardly to dispose the lugs 51 beneath the shoulder 37, whereby upon upward movement of the retrieving tool R, as shown in FIG. 3, the upper lug surfaces 53 will interlock with the pulling shoulder 37 of the wedge-lock ring 32, whereby the latter will be pulled upwardly. When the wedge-lock ring 32 is pulled upwardly, the split lock ring 28 is freed so that it may expand outwardly, allowing the packing support sleeve 26** to then be pulled upwardly relative to the housing H and the casing hanger body C.

In the event that sediment or the like is so deposited about the wedge-lock ring 32 as to prevent its being pulled upwardly by the retrieving tool R, the body 41 is provided with means for enabling a washing fluid to be circulated downwardly through the pipe string 44 and upwardly through the body passages 45 to flush the sediment away. In this connection the body 41 has a suitable number of circumferentially spaced passages 56 leading from a chamber 57 at the juncture of the body with the pipe string 44, these passages 56 opening downwardly and outwardly through circumferentially spaced jet nozzles 58 which are directed towards the annular space 14 between the housing H and the casing hanger C in which the packing and lock means are received.

In the event that even after washing or flushing sediment from the apparatus, as just described, the locking wedge ring 32, nevertheless, cannot be pulled, the retainer ring 54 can be sheared by applying sufficient upward pull on the pipe string 44. Under these circumstances subsequent recovery operations can be performed.

In accordance with another form of the invention as shown in FIGS. 4 through 8, means 100 are provided whereby the latch fingers are retractable or disengageable from the pulling collar 37 of the lock-wedge ring 32. In this form, the retrieving tool has its body 101 threadedly connected at 102 to the lower end of the tubular pipe string 103. The flexible finger means 48 includes a support ring or body 104 threadedly connected at 105 to the body 101 and having the circumferentially spaced and downwardly extended flexible fingers or latch elements 106 separated by longitudinal slots 107. As in the previously described embodiment, each of the fingers 106 has at its lower end a lug 108 provided with a downwardly and inwardly inclined surface 109 engageable with the bevelled surfaces 40*a* and 37*a* on the sleeve 26 and the wedge-lock ring 32, to flex the fingers inwardly as the retrieving tool is lowered into the position of FIGS. 4 and 6. Each lug 108 on the fingers 106 also has the upwardly and outwardly inclined surface 110 engageable with the pulling collar or shoulder 37 on the wedge-lock ring 32 to apply an upward pull thereto, as in the case of the previously described embodiment.

The retracting means 100 for releasing the latch lugs 108 from the pulling collar or shoulder 37 includes an actuator sleeve 112 reciprocably disposed in a bore 113 in an outer body section 114 which is threaded onto the main body 101 at 115, the outer body section 114 having fluid passages 116 extending longitudinally to enable the bypass of fluid about the body assembly.

At its upper end, the actuator sleeve 112 has a cylinder section 117 including an upper cylindrical end 118 slidably and sealingly engaged by an upper seal ring 119 carried on the body 101. A piston 120 on the cylinder section 117 has a reduced diameter and sealingly engages a lower seal ring 121 carried by a reduced section 122 of the body 101. Between the seals 119 and 121 is formed a chamber 123 to which fluid under pressure can be supplied, as later described, to force the actuator sleeve 112 downwardly to release the latch fingers 106. Downward movement of the actuator sleeve 112 releases the fingers 106 from the pulling shoulder 37 of the wedge-lock ring 32 by engagement of a lower end surface 124 on the actuator sleeve 112 which is inclined downwardly and outwardly and is engageable with an upwardly and inwardly inclined surface 125 on a lug 126 on each latch finger 106. The opposed surfaces 124 on the sleeve 112 and 125 on the finger lugs 126, upon downward movement of the actuator sleeve from the position of FIG. 6 to the position of FIG. 8, will be seen to flex the latch fingers 106 inwardly. Since the lugs 126 are located well above the lower ends of the latch fingers 106, only slight movement of the sleeve 112 is required to effect the necessary inward movement of the latch lugs 108 on the fingers 106 to the released position of FIG. 8.

As previously indicated, pressure applied to the piston chamber 123 is employed to force the actuator sleeve downwardly when desired. The body 101 has pressure fluid passages 130 leading to the piston chamber 123 from a bore 131 in the body 101. These passages 130 are normally closed by a valve sleeve 132 which is disposed in the bore 131 and normally held in an upper position (FIG. 4) by a coiled compression spring 133 which seats at its lower end in a seat 134 and engages in a seat 135 in the lower side of the sleeve 132. A split retainer ring 136 engaged in the body 101 limits upward movement of the valve 132 and retains it in the bore 131.

As in the case of the previously described embodiment, fluid can be circulated downwardly through the pipe string 103 and through passages 137 in the body 101, through nozzles 138, to wash sediment from the locking means L. In the present form, the valve sleeve 132 has a number of radial ports 139 leading to an annulus 140 in the tool body 101, and the washing passages 137 communicate with the annulus 140. The valve sleeve 132 has through passages 141 leading to the bore 131 below the valve sleeve so that the valve sleeve is balanced and is not shifted downwardly by fluid pressure during the washing operation.

Figure 7:
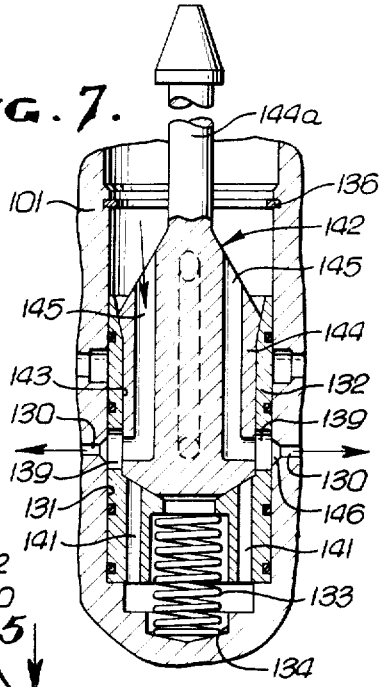
FIG. 7 is a fragmentary detail view in longitudinal section, showing a fluid pressure responsive dart set in the valve sleeve of FIG. 4.
Figure 6:
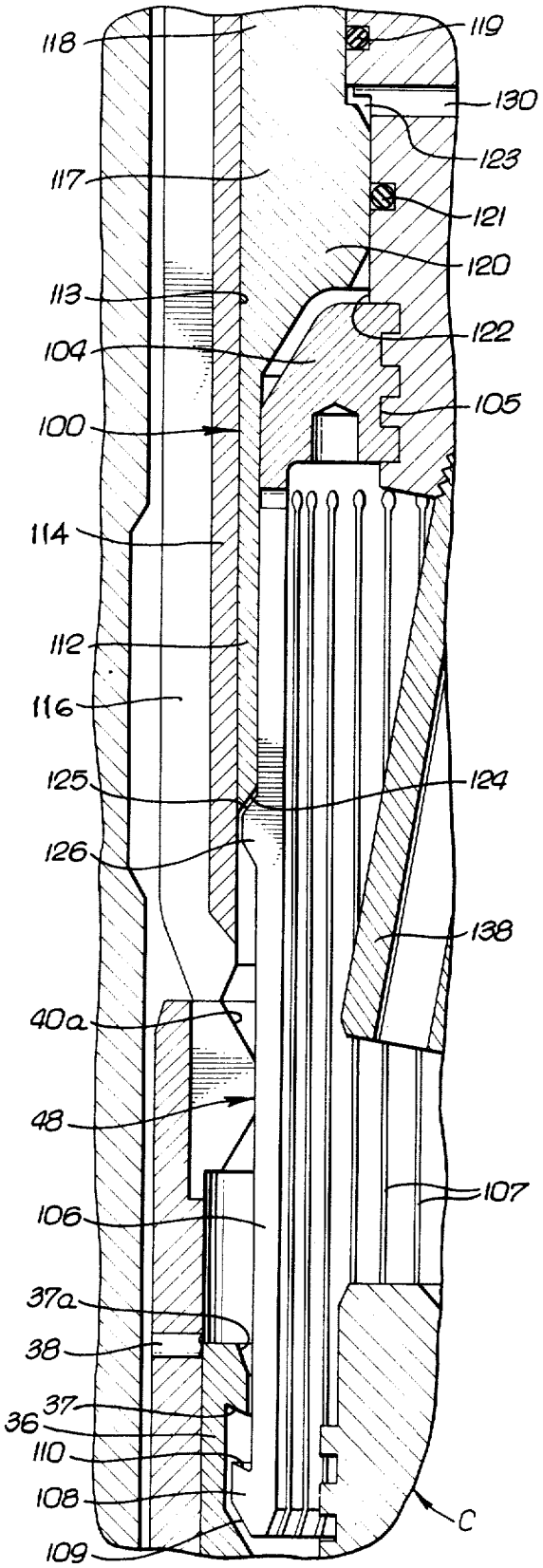
FIG. 6 is an enlarged fragmentary detail view, showing the pulling fingers, the pulling collar and the finger releasing means in the condition of FIG. 4.
Figure 8:
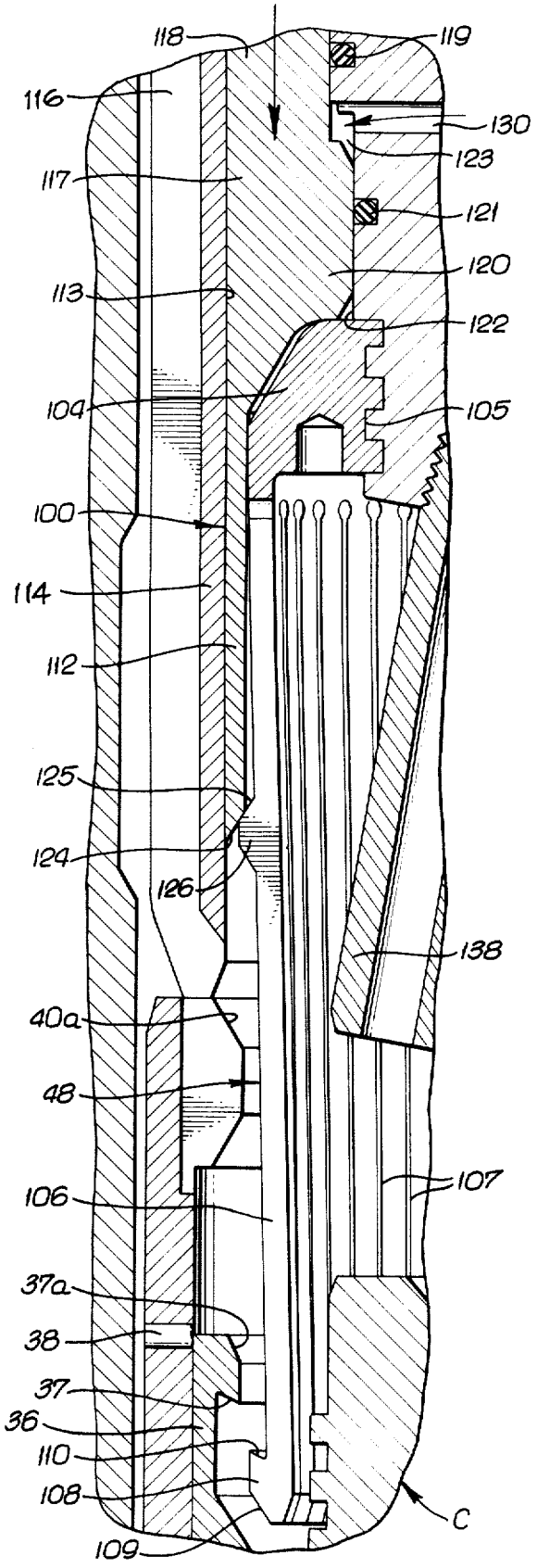
FIG. 8 is a view corresponding to FIG. 6, but showing the pulling fingers actuated to the released condition.

When and if it becomes necessary to establish communication between the bore 131, the pipe string 103 and the piston chamber 123, to release the fingers 106, as described above, the valve sleeve 132 is shifted downwardly to establish communication between the valve ports 139 and the body passages 130, as seen in FIG. 7. To accomplish this, a dart 142 is dropped into the pipe string 103 and seats in the bore 143 within the valve sleeve 132. The dart 142 has a body 144 which closely fits in the valve bore 143 and a retrieving neck 144*a*. As the dart enters the bore 143 during the flow of fluid through the valve sleeve 132, the flow is so shutoff or diminished that the pressure shifts the valve sleeve 132 downwardly and seats the dart in the bore 143, so that passages 145 in the dart communicate with the valve ports 139 which are then in communication with an annulus 146 which communicates with the ports 130 leading to the piston chamber 123 for actuating the latch release sleeve 112 downwardly. The entire retrieving tool can then be pulled from the housing H and other removal methods resorted to for removing the packing H.

I claim:

1. A retrieving tool for pulling a packing and locking apparatus from the annular space between a wellhead and a casing hanger in the wellhead, said packing and locking apparatus having a pulling shoulder facing downwardly, said tool comprising: a body having means connectable to an operating pipe string for lowering said body and pulling upwardly on said body, latch means carried by said body including circumferentially spaced flexible fingers having latch lugs projecting laterally outwardly therefrom and adapted to be disposed within said apparatus and below said pulling shoulder for engagement with said pulling shoulder, and fluid passage means in said body leading from said pipe string and comprising a plurality of nozzles within said fingers for discharging fluid within said fingers and toward said lugs and to conduct washing fluid to the vicinity of said packing and locking apparatus.

2. A retrieving tool as defined in claim 1, including means responsive to a predetermined pull on said body by said pipe string for releasing said latch fingers from said body.

3. A retrieving tool as defined in claim 1, including actuator means shiftable downwardly of said body for flexing said latch fingers from latching relation with said pulling shoulder.

4. A retrieving tool as defined in claim 1, wherein said latch lugs have an upwardly facing shoulder engageable with said pulling shoulder facing downwardly.

5. A retrieving tool as defined in claim 1, wherein said latch lugs have an upwardly facing shoulder engageable with said pulling shoulder facing downwardly, and an inclined surface engageable with said apparatus for flexing said fingers to enable passage of said lugs past said pulling shoulder.

6. A retrieving tool as defined in claim 1, wherein said latch means includes a circumferentially continuous ring integral with said fingers, said body having an annular groove receiving said ring, and retainer means securing said ring in said groove.

7. A retrieving tool as defined in claim 1, wherein said latch means includes a circumferentially continuous ring integral with said fingers, said body having an annular groove receiving said ring, and retainer means securing said ring in said groove, one of said retainer means and said ring being shearable to release said latch means from said body upon excessive upward pull on said pipe string.

8. A retrieving tool as defined in claim 1, including actuator means carried by said body and shiftable downwardly relative to said fingers for flexing said fingers from latching relation with said pulling shoulder, said actuator means including a sleeve on said body and fluid pressure operated means for shifting said sleeve downwardly relative to said fingers, said fingers and said sleeve having coengageable surfaces for flexing said fingers.

9. A retrieving tool as defined in claim 1, including fluid pressure operated actuator means shiftable downwardly of said body for flexing said fingers from latching relation with said pulling shoulder.

10. A retrieving tool is defined in claim 1, wherein said body has outer peripheral grooves enabling the by-pass of fluid.

11. A retrieving tool for pulling a packing and locking apparatus from the annular space between a wellhead and a casing hanger in the wellhead, said packing and locking apparatus having a pulling shoulder facing downwardly, said tool comprising: a body having means connectable to an operating pipe string for lowering said body and pulling upwardly on said body, latch means carried by said body including circumferentially spaced flexible fingers having latch lugs projecting therefrom and engageable with said pulling shoulder, and fluid passage means in said body leading from said pipe string to the vicinity of said fingers for conducting washing fluid to the vicinity of said packing and locking apparatus, including fluid pressure operated actuator means for flexing said fingers from latching relation with said pulling shoulder, said fluid pressure operated actuator means including a sleeve shiftably mounted on said body, said body and said sleeve having means defining a piston chamber, a piston on said sleeve exposed to the pressure of fluid in said piston chamber, and passage means leading from said pipe string to said piston chamber.

12. A retrieving tool as defined in claim 11, and valve means for diverting fluid from the first-mentioned passage means to the second-mentioned passage means.

13. A retrieving tool for pulling a packing and locking apparatus from the annular space between a wellhead and a casing hanger in the wellhead, said packing and locking apparatus having a pulling shoulder facing downwardly, said tool comprising: a body having means connectable to an operating pipe string for lowering said body and pulling upwardly on said body, latch means carried by said body including circumferentially spaced flexible fingers having latch lugs projecting therefrom and engageable with said pulling shoulder, and fluid passage means in said body leading from said pipe string to the vicinity of said fingers for conducting washing fluid to the vicinity of said packing and locking apparatus, wherein said fingers have lugs projecting therefrom, an actuator sleeve having a surface adjacent to said lugs, said body and said sleeve having means including a piston on said sleeve forming a piston chamber, and passage means leading to said piston chamber from said pipe string to conduct pressure fluid to said piston chamber for shifting said sleeve relative to said fingers, whereby said surface on said sleeve cams said fingers from latching relation with said pulling shoulder.

14. A retrieving tool as defined in claim 13, said body having a bore, a valve sleeve in said bore, means normally holding said valve sleeve in a position at which the first-mentioned passage means is connected with said pipe string and the second-mentioned passage means is closed, said valve sleeve being shiftable to a position at which said first-mentioned passage means is closed and said second-mentioned passage means is open.

15. A retrieving tool for pulling a packing and locking apparatus from the annular space between a wellhead and a casing hanger in the wellhead, said packing and locking apparatus having a pulling shoulder facing downwardly, said tool comprising: a body having means connectable to an operating pipe string for lowering said body and pulling upwardly on said body, said body having an annular groove, latch means including a circumferentially continuous ring disposed in said groove, flexible fingers integral with and extending downwardly from said ring, a retainer carried by said body and holding said ring in said groove, and latch lugs on said fingers engageable with said pulling shoulder upon downward movement of said body into engagement with said packing and locking apparatus.

16. A retrieving tool for pulling packing and locking apparatus from the annular space between a wellhead and a casing hanger in the wellhead, said packing and locking apparatus having a pulling shoulder facing downwardly, said tool comprising: a body having means connectable to an operating pipe string for lowering said body and pulling upwardly on said body, latch means carried by said body including a plurality of flexible latch fingers extending downwardly from said body and having lugs engageable with said pulling shoulder upon downward movement of said body into engagement with said packing and locking apparatus, said fingers having cam surfaces spaced above said lugs, an actuator sleeve shiftable in said body and having a surface engageable with said cam surfaces, upon downward movement of said sleeve with respect to said body and fingers, to flex said lugs from latching relation with said pulling shoulder, and fluid pressure operated means for shifting said actuator sleeve downwardly of said body and fingers.

17. A retrieving tool for pulling a packing and locking apparatus from the annular space between a wellhead and a casing hanger in the wellhead, said packing and locking apparatus having a pulling shoulder facing downwardly, said tool comprising: a body having means connectable to an operating pipe string for lowering said body and pulling upwardly on said body, latch means carried by said body including a plurality of flexible latch fingers extending downwardly from said body and having lugs engageable with said pulling shoulder upon downward movement of said body into engagement with said packing and locking apparatus, said fingers having cam surfaces spaced above said lugs, an actuator sleeve shiftable in said body and having a surface engageable with said cam surfaces to flex said lugs from latching relation with said pulling shoulder, and fluid pressure operated means for shifting said actuator sleeve including a piston on said sleeve, said sleeve, said piston and said body having portions defining a piston chamber, and passage means leading through said body to said piston chamber from said pipe string.

18. A retrieving tool as defined in claim 17, including valve means normally closing said passage means.

* * * * *

UNITED STATES PATENT AND TRADEMARK OFFICE

CERTIFICATE OF CORRECTION

PATENT NO. : 3,944,273

DATED : March 16, 1976

INVENTOR(S) : ARTHUR G. AHLSTONE

It is certified that error appears in the above-identified patent and that said Letters Patent are hereby corrected as shown below:

Column 2, line 30, after "but" change "is" to -- it --.

Column 3, line 26, after "U.S." insert -- Letters --.

Column 4, line 30, change "invenntion" to -- invention --.

Column 6, line 32, before "sleeve" insert -- valve --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*